US005241246A

United States Patent [19]

Lapatovich et al.

[11] Patent Number: 5,241,246

[45] Date of Patent: Aug. 31, 1993

[54] END CUP APPLICATORS FOR HIGH FREQUENCY ELECTRODELESS LAMPS

[75] Inventors: Walter P. Lapatovich, Marlborough; Scott J. Butler, N. Oxford; Jason R. Bochinski, Natick, all of Mass.

[73] Assignee: GTE Laboratories Incorporated, Waltham, Mass.

[21] Appl. No.: 757,095

[22] Filed: Sep. 10, 1991

[51] Int. Cl.[5] ..... H05B 41/16

[52] U.S. Cl. ..... 315/248; 315/344

[58] Field of Search ..... 315/248, 344, 39, 111.81; 313/607, 234; 333/24 C

[56] References Cited

U.S. PATENT DOCUMENTS

| | | | |
|---|---|---|---|
| 3,942,068 | 3/1976 | Haugsjaa | 315/39 |
| 3,943,403 | 3/1976 | Haugsjaa | 315/248 |
| 3,993,927 | 11/1976 | Haugsjaa | 315/248 |
| 4,041,352 | 8/1977 | McNeill et al. | 315/248 |
| 4,053,814 | 10/1977 | Regan | 315/248 |
| 4,266,162 | 5/1981 | McNeill et al. | 315/39 |
| 4,498,029 | 2/1985 | Yoshizawa | 315/248 |

OTHER PUBLICATIONS

Macor Corning Machinable Glass Ceramic Duramic Products, Inc. Data Bulletin MOS-2.

*Primary Examiner*—Eugene R. LaRoche
*Assistant Examiner*—A. Zarabian
*Attorney, Agent, or Firm*—Carl F. Ruoff; Victor F. Lohmann; William E. Meyer

[57] ABSTRACT

A high frequency applicator for energizing electrodeless lamps is described. The applicators are end cups electrically attached to the ends of phased feed points of a planar transmission line, and facing each other so as to form a gap between the end cups. The end cups each have a concave surface facing the gap which forces an electric field concentration in the vicinity of the end cups and in the gap between the opposing end cups. Such a field configuration is useful for energizing a lamp capsule placed within the gaps formed by the end cups. The end cups can be made of metal or metallized ceramic.

7 Claims, 3 Drawing Sheets

END CUP APPLICATORS FOR HIGH FREQUENCY ELECTRODELESS LAMPS

BACKGROUND OF THE INVENTION

The present invention relates to a high frequency applicator for energizing electrodeless lamps. More specifically, metallized ceramic or metal blocks facing each other to form a gap are shaped so as to force an electric field concentration in the gap between the blocks thereby providing an RF application system for electrodeless lamps.

Cup like termination fixtures for energizing electrodeless lamps are depicted by McNeill in U.S. Pat. No. 4,041,352 which shows single ended excitation, and in U.S. Pat. No. 4,266,162 which discloses double ended excitation. The more relevant patent is U.S. Pat. No. 4,266,162 in which McNeill is concerned with elongated sources, and in which he recites the virtues of double ended excitation (see col. 7, lines 54–68). While the pictures show cup-like termination fixtures as the applicator of power to the lamps, they are not described in detail. In claim 1, McNeill cites the termination load approach, and in claim 5 McNeill cites the need to control the electric field in the vicinity of the lamp envelope. In addition, McNeill U.S. Pat. No. 4,266,162 requires an outer conductor disposed around the coupling fixtures.

Applicators for energizing electrodeless discharges using planar transmission lines and helical couplers are described by Lapatovich in U.S. Pat. No. 5,070,277. In this reference slow wave applicators made from helical coils are described.

The present invention relates to a novel applicator for energizing an electrodeless lamp.

SUMMARY OF THE INVENTION

The present invention relates to a coupling system for energizing electrodeless lamps. The system includes a first end cup receiving microwave power at a first end and having a second end shaped as a concave surface facing a gap. A second end cup is positioned coaxial with the first end cup and has a first end receiving microwave power and a second end shaped as a concave surface and facing the gap wherein the lamp capsule is placed. The gap is formed by the concave surfaces of the two end cups. The two end cups are electrically coupled to be 180° out of phase.

The coupling system performs best when the two end cups are supplied by an electrical connection which constitutes a balun impedance transformer between the lamp capsule and the microwave power source and the transmission line delivery power to the coupling system.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE PREFERRED EMBODIMENT

A high frequency applicator for energizing electrodeless lamps is described. The applicators are formed from two blocks of material electrically attached to the ends of phased feed points of a planar transmission line and facing one another so as to make a gap between the blocks. The blocks of material may be metal or metallized ceramic. The shaping of the faces of the blocks forces an electric field concentration in the vicinity of the block and in the gap between opposing blocks. Such a field configuration is desirable for energizing an electrodeless discharge in a capsule placed within the gap formed by the opposing blocks. The shaping is contoured to produce an electric field enhancement away from the surface of block so as to be coincident with the internal volume of a gas discharge lamp placed within the gap to cause excitation of the gas therein to a radiating state.

Figure 1:
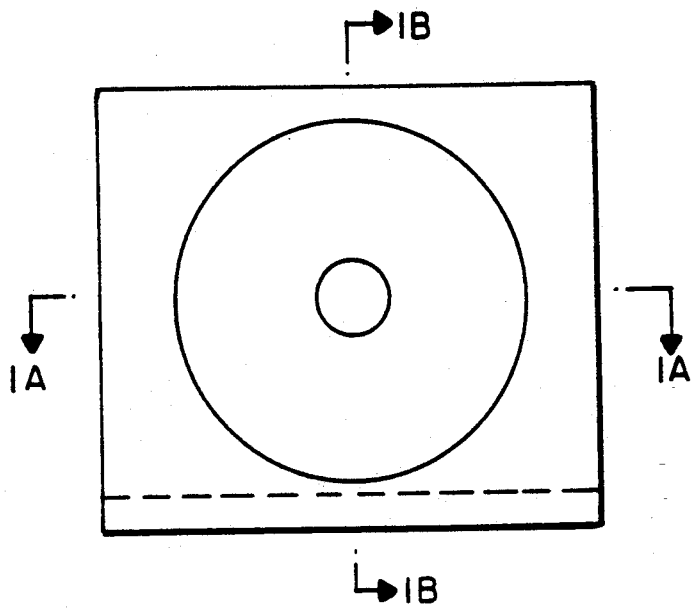
FIGS. 1, 1A, 1B show three views of the end cup applicators of one embodiment of the present invention.
Figure 1B:
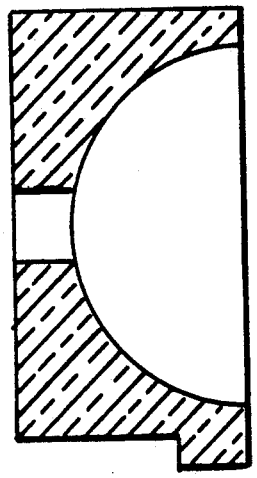
Figure 1A:
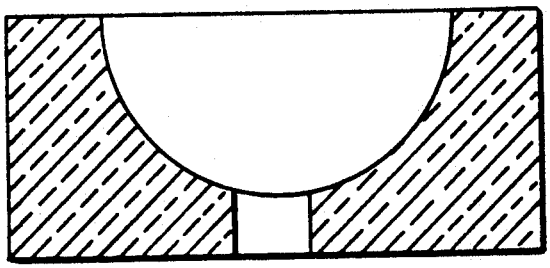
Figure 2:
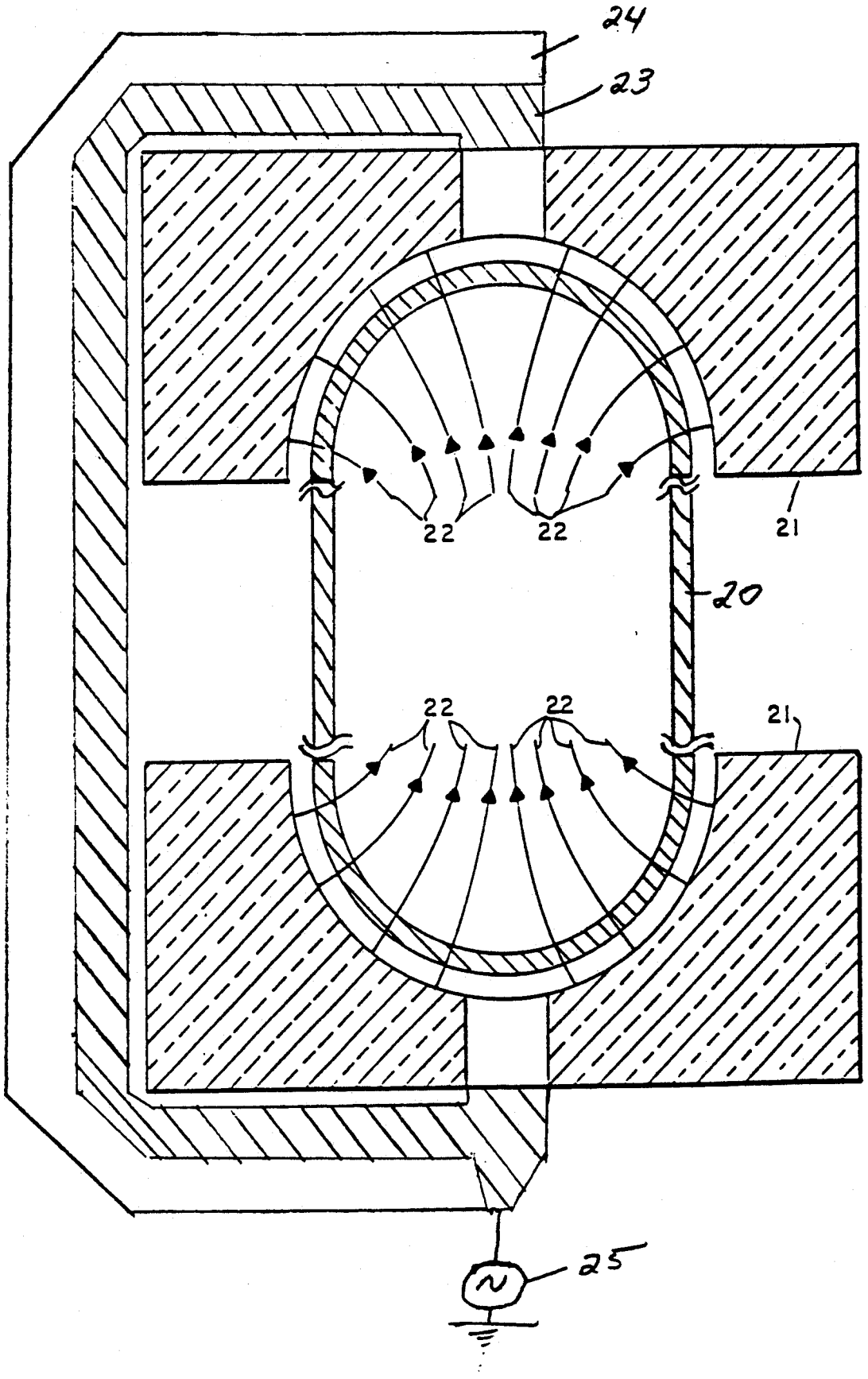
FIG. 2 shows a lamp capsule positioned between the end cup applicators of one embodiment of the present invention.

Further description of an applicator according to the present invention is by way of reference to the enclosed drawings. FIG. 1 shows three views of a solid metal end cup field enhancing applicator. The metal used in the tests was copper plated with nickel, and then a layer of gold. The small central hole is used to pass the mechanical support (i.e. a small quartz tube) for the lamp capsule. While this is the preferred embodiment, it should be obvious to one skilled in the art that the "blocks" need not be rectangular parallelpipeds. Only the concave surfaces facing the gap are responsible for the electric field enhancement. FIG. 2 shows a cross sectional view of the lamp capsule 20 positioned within the gap formed by facing metallic end cups 21 the electric field lines 22 generated by the device. The lamp capsule is not in contact with the end cups at any point. The field lines 22 density is a measure of the electric field strength and increases along the axis of the lamp capsule locally near the end cup applicator. A quasistatic analysis of the axial electric field shows an axial electric field enhancement of about 2.7 times greater than the field generated between plane parallel metallic blocks.

As shown, a microwave power source 25 supplies power to both the first and second end cups via a microstrip transmission line 23. Preferably, the transmission line is a balun impedance transformer. The first and second end cups are supported by an insulative card 24 having microstrip line 23 formed on one side and a ground surface formed on the opposite side.

Figure 3:
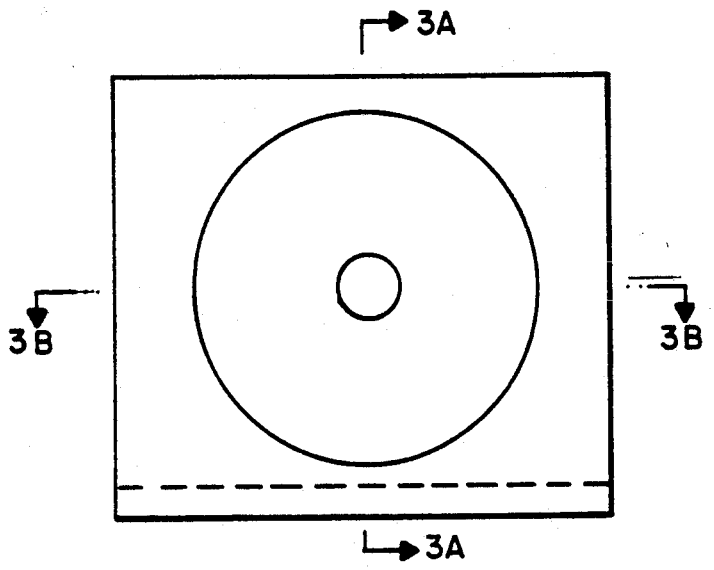
FIGS. 3, 3A, 3B show three views of an alternate end cup applicator of one embodiment of the present invention.
Figure 3A:
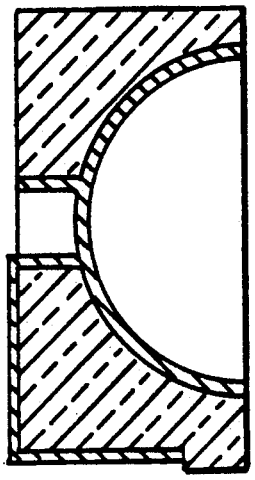
Figure 3B:
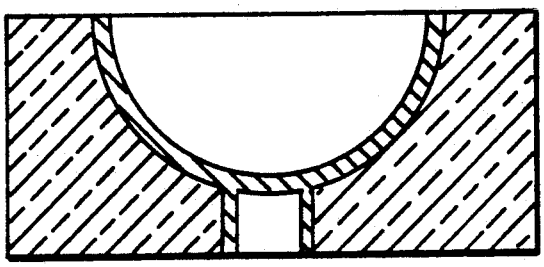

FIG. 3 shows an alternative design for end cups applicators using metallized ceramic blocks. In the example, titanium-tungsten-gold was applied to machined Macor®. Other materials from which the blocks can be fabricated include quartz, alumina, beryllia and high temperature plastics. The advantage of this technique is the reduced thermal conductivity of the end cup so formed. Additionally, the reduction of the sheer metal mass reduces the stray capacitance of the end cup with nearby metallic surfaces making the applicator easier to tune to the lamp operating impedance. The metallization as depicted allows for soldering to the planar transmission line and for the field shaping via the concave surface. Again, it should be obvious to one skilled in the art that the ceramic piece serves only as a support for the concave metallic surface, and that other geometries may be used other than rectangular parallelpipeds.

The curvature of the end cups is designed to approximate the curvature of the lamp end chambers as shown in FIG. 2. The radius of curvature of the end cups is in the range of 0.1 to 10 mm larger than the radius of the lamp end chambers with the preferred differential of 0.5 mm for lamps operating at approximately 25 W. Consequently, the end cups of the lamp do not contact the lamp at any point. Both metallic and metallized ceramic types were tested on microstripline at 915 MHz and 2.45 GHz. The lamps in both cases operated similarly to helically excited lamps as described in U.S. Pat. No. 5,070,277. It is apparent that these end cup applicators may be used at frequencies other than the two cited above.

The lamp capsule used in the present disclosure were made of quartz and had an outer diameter of 3 mm and an inner diameter of 2 mm. The capsules had an internal length of approximately 10 mm. However, lamps of other dimensions are easily powered by the applicators of the present invention.

The lamp capsule encloses a lamp fill that may include various additional doping materials as are known in the art. The lamp fill composition is chosen to include at least one material that is vaporizable and excitable by radio frequency power. The lamp fill compositions useful in the present invention are those familiar in arc discharge tubes. The preferred gas is a Penning mix of largely neon with a small amount (<1%) of argon although xenon, kryptron, argon or pure neon may be used. The lamp fill includes a metallic compound such as a salt like scandium iodide. The lamp fill used is approximately 0.3 milligram of mercury, 0.1 milligram of sodium-scandium iodide with a Penning gas mixture at about twenty torr. The Penning gas mixture consisted of approximated 0.005% argon in neon.

The end cup design lends itself to mass production easier than the helical coils. Automated machinery can handle the small rectangular parallelpipeds easier than the helical coils with less chance of entangling.

While there has been shown and described what are at present considered the preferred embodiment of the present invention, it will be obvious to those skilled in the art that various changes, alterations and modifications may be made therein without departing from the scope of the invention as defined by the appended claims.

What is claimed is:

1. A coupling system for delivering microwave power to a lamp capsule comprising:

a first end cup receiving microwave power at a first end and having a second end having a concave conductive surface facing a gap; and a second end cup receiving microwave power at a first end positioned coaxial with the first end cup and having a second end having a concave conductive surface facing the gap to contain a lamp capsule and facing the concave surface of said first end cup wherein the first end cup and the second end cup are electrically coupled to be 180° out of phase in delivering power to the lamp capsule, wherein the concave surfaces surround but do not touch end chambers of said lamp capsule, and the separations between the surfaces and the lamp capsule are approximately 0.1 to 10 mm.

2. A coupling system for delivering microwave power to a lamp capsule comprising:

a first end cup receiving microwave power at a first end and having a second end having a concave conductive surface facing a gap; and a second end cup receiving microwave power at a first end positioned coaxial with the first end cup and having a second end having a concave conductive surface facing the gap to contain a lamp capsule and facing the concave surface of said first end cup wherein the first end cup and the second end cup are electrically coupled to be 180° out of phase in delivering power to the lamp capsule, wherein the conductive surfaces of the first and second end cups have central apertures in which support means for a lamp capsule can be placed therethrough.

3. A microwave powered lamp comprising:

a first end cup receiving input microwave power at a first end and having a second end comprising a concave conductive surface facing a gap;

a second end cup position coaxial with the first end cup and receiving input power at a first end and having a second end comprising a concave conductive surface facing the gap and facing the concave surface of the first end cup;

a lamp capsule positioned in the gap and whose end chambers are separated from the concave surfaces of the first and second end cup by a distance of approximately 0.1 mm to 10 mm.

4. The lamp according to claim 3 wherein the end cups are made of metal.

5. The lamp according to claim 3 wherein the end cups are made from a dielectric and the surfaces are made of metal.

6. The lamp according to claim 3 wherein the concave surfaces are made from a high temperature superconductor.

7. The lamp according to claim 3 wherein the first and second end cups are electrically coupled to be 180° out of phase.

* * * * *